US011441336B2

(12) United States Patent
Nam et al.

(10) Patent No.: US 11,441,336 B2
(45) Date of Patent: Sep. 13, 2022

(54) MOTOR-DRIVEN DOOR LATCH FOR VEHICLE

(71) Applicants: Hyundai Motor Company, Seoul (KR); Kia Motors Corporation, Seoul (KR)

(72) Inventors: Jinwoo Nam, Seoul (KR); Kyoung Taek Kwak, Yongin-si (KR); Jungho Han, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 546 days.

(21) Appl. No.: 16/508,766

(22) Filed: Jul. 11, 2019

(65) Prior Publication Data

US 2020/0347649 A1 Nov. 5, 2020

(30) Foreign Application Priority Data

May 2, 2019 (KR) ..... 10-2019-0051215

(51) Int. Cl.
*E05B 79/06* (2014.01)
*E05B 79/08* (2014.01)
(Continued)

(52) U.S. Cl.
CPC ..... *E05B 79/06* (2013.01); *E05B 65/1026* (2013.01); *E05B 79/08* (2013.01); *E05B 2047/0014* (2013.01)

(58) Field of Classification Search
CPC ..... E05B 79/06; E05B 79/08; E05B 65/1026; E05B 65/0014; E05B 2047/0014;
(Continued)

(56) References Cited

U.S. PATENT DOCUMENTS 7,523,969 B2 4/2009 Thornton et al.
8,474,888 B2 * 7/2013 Tomaszewski ..... E05B 77/30 292/201
(Continued)

FOREIGN PATENT DOCUMENTS

CN 1253606 A 5/2000
CN 2861416 Y 1/2007
(Continued)

*Primary Examiner* — Christine M Mills
*Assistant Examiner* — Yahya Sidky
(74) *Attorney, Agent, or Firm* — Slater Matsil, LLP

(57) ABSTRACT

A motor-driven door latch for a vehicle includes a catch part which is caught on a striker mounted on the vehicle. A door locking and releasing part includes a main motor and applies torque to the catch part through the main motor to allow the catch part to be locked to or released from the striker. A motor-driven emergency door releasing part is provided with an auxiliary motor and is contacted with the door locking and releasing part. An inside emergency operating lever is connected with an inside handle installed at the door for the vehicle. An outside emergency operating lever is connected with an outside handle installed at the door for the vehicle. A manual emergency door release part is connected with the inside emergency operating lever.

20 Claims, 16 Drawing Sheets

(51) Int. Cl.
*E05B 65/10* (2006.01)
*E05B 47/00* (2006.01)

(58) Field of Classification Search
CPC ..... E05B 17/0029; E05B 77/26; E05B 81/00; E05B 81/04; Y10T 292/1082; Y10T 292/1047; Y10S 292/23; Y10S 292/65
See application file for complete search history.

(56) References Cited

U.S. PATENT DOCUMENTS

| | | | | |
|---|---|---|---|---|
| 10,472,865 | B2 * | 11/2019 | Vazquez | E05B 81/16 |
| 2002/0043409 | A1 | 4/2002 | Parkert et al. | |
| 2011/0214460 | A1 * | 9/2011 | Byun | E05B 81/00 70/91 |
| 2016/0362916 | A1 * | 12/2016 | Tomaszewski | E05B 81/90 |
| 2018/0023325 | A1 * | 1/2018 | Takagi | E05B 81/64 292/259 A |

FOREIGN PATENT DOCUMENTS

| | | | | |
|---|---|---|---|---|
| CN | 101395330 | A | 3/2009 | |
| CN | 108487801 | * | 9/2018 | |
| DE | 2014016787 | A1 | 5/2016 | |
| FR | 2919647 | A1 * | 2/2009 | E05B 81/20 |
| KR | 101513000 | B1 * | 4/2015 | |
| WO | 2016074842 | A1 | 5/2016 | |
| WO | WO-2018193299 | A1 * | 10/2018 | E05B 81/16 |

* cited by examiner

MOTOR-DRIVEN DOOR LATCH FOR VEHICLE

CROSS-REFERENCE TO RELATED APPLICATIONS

This application claims priority to Korean Patent Application No. 10-2019-0051215, filed in the Korean Intellectual Property Office on May 2, 2019, which application is hereby incorporated herein by reference.

TECHNICAL FIELD

The present invention relates to a motor-driven door latch for a vehicle.

BACKGROUND

Generally, a motor-driven door latch for a vehicle is used to lock or unlock a door to a vehicle body by using a motor for the convenience of the user.

In addition, an inside handle and an outside handle are respectively installed to allow the user to grasp the vehicle door and to easily operate the vehicle door, and a switch or the like is provided on the vehicle door for locking or releasing the motor-driven door latch.

On the other hand, the door for the vehicle is provided with a separate power child lock device operated by electric power to prevent the door locked to the vehicle body from accidentally being released by inadvertently operating the inside handle of the child occupant in the rear seat. This power chill lock device has been implemented using a motor or a link separately from the motor-driven door latch, thereby increasing the number of components, weight and cost of the vehicle.

Furthermore, in the door for the vehicle, a so-called deadlock device that functions the door locked to the vehicle body not to be forcibly opened from the vehicle interior or exterior without using a key or a remote controller of the vehicle, is installed to prevent the vehicle from being stolen. The dead lock device has been implemented using a motor or a link separately from the motor-driven door latch, thus increasing the number and weight and cost of the vehicle.

The above information disclosed in this Background section is only for enhancement of understanding of the background of the invention and therefore it may contain information that does not form the prior art that is already known in this country to a person of ordinary skill in the art.

SUMMARY

The present invention integrates the motor-driven door latch function, a power child lock function and a dead lock function to realize a more compact motor-driven door latch device.

In particular embodiments, the present invention relates to a motor-driven door latch for a vehicle capable of integrally implementing functions of locking or releasing the door locked to a vehicle body using a motor, in addition, releasing the door locked to the vehicle body in an emergency, a power child lock for safe operation of the inside handle installed on the door for manual release of the locked door, and a so-called dead lock that prevents the door locked to the vehicle body from being forcibly released at the vehicle interior or exterior without using the key or remote controller of the vehicle.

Embodiments of the invention can provide a motor-driven door latch for a vehicle capable of implementing a motor-driven door latch function, a door release function for emergency, a power child lock function and a dead lock function by using motors, thereby implementing a compact and smart door for a vehicle.

A motor-driven door latch for a vehicle according to an exemplary embodiment of the present invention may include a catch part which is caught on a striker mounted on the vehicle to lock a door for a vehicle to a vehicle body or is released from the striker so that the door can be opened from the vehicle body. A door locking and releasing part includes a main motor and applies torque to the catch part through the main motor to allow the catch part to be locked to or released from the striker. A motor-driven emergency door releasing part is provided with an auxiliary motor and contacted with the door locking and releasing part by the operation of the auxiliary motor when the main motor is not operated. An inside emergency operating lever is connected with an inside handle installed at the door for the vehicle and receives an operation force of the inside handle to rotate and applies torque to the catch part through the emergency door releasing part and the door locking and releasing part. An outside emergency operating lever is connected with an outside handle installed at the door for the vehicle and receives an operation force of the outside handle to rotate and applies torque to the catch part through the emergency door releasing part and the door locking and releasing part. A manual emergency door release part is connected with the inside emergency operating lever and receives an operation force of the inside emergency operating lever to move and applies torque to the catch part through the emergency door releasing part and the door locking and releasing part.

The catch part may include a catch having a locking groove which the striker mounted on the vehicle body is catch in or separated from and being installed to be rotatable; and a pawl installed to be rotatable and in close contact with the catch to limit the rotation of the catch or separated from the catch to allow the catch to be freely rotatable.

The door locking and releasing part may include the main motor, which can rotates in a clockwise and anticlockwise directions and includes a first drive gear; a first driven gear engaged with the first drive gear; a pawl release lever coupled to the pawl to be integrally rotated; and a first operating lever, which is engaged with the first driven gear and receives the torque through the first driven gear to rotate the pawl release lever.

The emergency door releasing part may include the auxiliary motor including a second drive gear; a second driven gear engaged with the second drive gear; a master locking link, which is installed to be rotatable, contacted with the second driven gear so that the rotation thereof is limited and includes a hook at one end portion thereof; and a pressurizing spring applying an elastic force to the master locking link in order to rotate the master locking link in a direction.

Two seating protrusions may be formed at the pawl release lever; and a pressurizing protrusion which seats on the seating protrusions, and presses and rotates the pawl release lever, may be provided at the first operating lever.

A door latch controller detecting an operation of a handle or a button installed at the door for the vehicle and applying an operation signal to the main motor, may be further included.

The auxiliary motor may be actuated by an operating signal of the door latch controller when the main motor is inoperable.

The inside emergency operating lever may be installed to be rotatable and one end portion thereof is provided with a pressurizing flange; and the master locking link may be provided with a rotation inducing flange, which corresponds to the pressurizing flange and is pressed by the pressurizing flange down to rotate the master locking link.

The outside emergency operating lever may be installed to be rotatable, one end portion thereof is formed with a wire hole with which a wire is connected and the other end portion thereof is formed with a first long hole; and the master locking link may be provided with a pin shaft inserted into the first long hole.

A key cylinder into which a key for a vehicle is inserted to operate may be provided with a key nut. The key nut is connected with one end portion of a key lever and the other end portion of the key lever is connected with the second driven gear.

The key lever may be formed with a second long hole at a lower portion thereof. The second driven gear is provided with a coupling protrusion inserted into the second long hole.

A protrusion may be provided at an upper portion of the key lever; the key nut is provided with two first and second operating protrusions spaced from each other in a circumference direction; and a movable groove into which the protrusion is inserted to move is provided between the first and second operating protrusions.

The manual emergency door release part may include a second operating lever coupled to a rotation shaft of the inside emergency operating lever to be 99—integrally rotated; a return spring installed at the rotation shaft of the inside emergency operating lever to return the inside emergency operating lever to its original position; a third operating lever installed to be moved by the second operating lever when the second operating lever rotates; and a return spring installed at the third operating lever to return the third operating lever to its original position after the third operating lever is moved; and wherein the key lever is connected with the third operating lever in order to be moved by the third operating lever.

The second operating lever may be provided with a push protrusion; and the third operating lever may be provided with a driven protrusion pushed by the push protrusion when the second operating lever rotates.

One side of the third operating lever may be provided with a long hole; and an upper portion of the key lever may be provided with a connection protrusion inserted into the long hole to connect the key lever with the third operating lever.

A power child lock switch; a rotation detecting sensor for detecting the second driven gear; and a door latch controller controlling the operations of the main motor and the auxiliary motor, may be further included, and the door latch controller may actuate the auxiliary motor when detecting the on-state of the power child lock switch and the rotation of the second driven gear through the rotation detecting sensor simultaneously.

A parking switch, a rotation detecting sensor for detecting the second driven gear, and a door latch controller controlling the operations of the main motor and the auxiliary motor may be further included. The door latch controller may actuate the auxiliary motor when detecting the on-state of the parking switch and the rotation of the second driven gear through the rotation detecting sensor simultaneously.

In accordance with a motor-driven door latch for a vehicle according to an exemplary embodiment of the present invention, since it is able to stably lock a door for a vehicle to a vehicle body and smoothly release the door locked to the vehicle body by using a main motor, user can conveniently use the door for the vehicle.

When the main motor is inoperable due to discharge or vehicle collision, and so on, since it is able to release the door locked to vehicle body by using an auxiliary motor and an inside handle or an outside handle, it is possible to improve use safety of the door for the vehicle.

When the main motor and the auxiliary motor are inoperable simultaneously, since it is able to release the door locked to the vehicle body by using a key for a vehicle, it is possible to improve use safety of the door for the vehicle.

Furthermore, since a power child lock function and a dead lock function can be implemented through an auxiliary moto, so that a smart and compact door for a vehicle can be realized, thereby reducing the number of parts and weight of the vehicle and improving marketability of the vehicle.

BRIEF DESCRIPTION OF THE DRAWINGS

These drawings are for reference purposes only and are not to be construed as limiting the technical idea of the present invention to the accompanying drawings.

Figure 1:
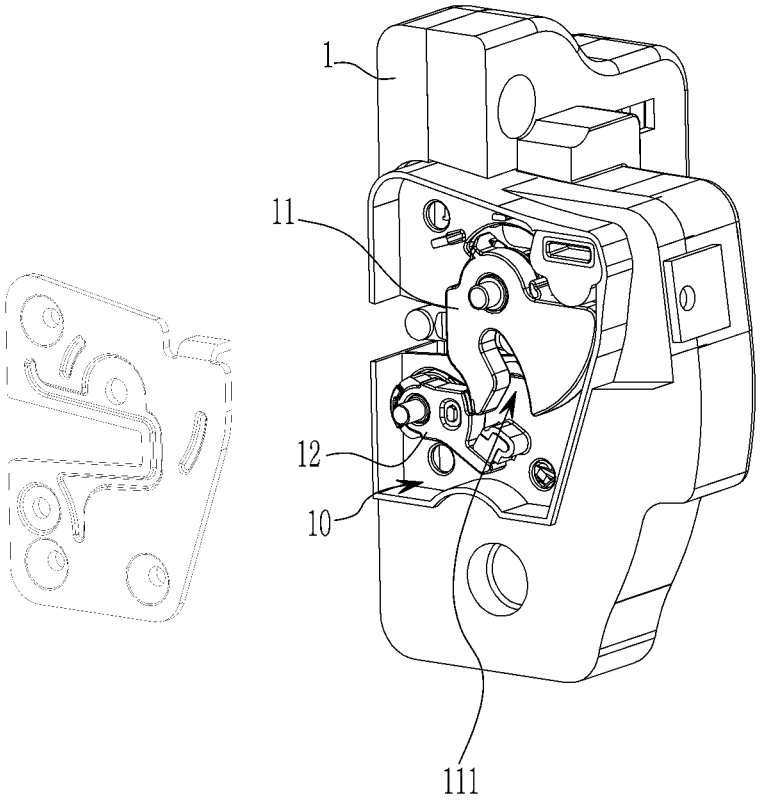
FIG. 1 is a side view of a motor-driven door latch for a vehicle according to an exemplary embodiment of the present invention.

The following reference numerals can be used in conjunction with the drawings:

1: first base plate
2: second base plate
10: catch part
11: catch
12: pawl
20: door locking and release part
21: main motor
22: first driven gear
23: pawl release lever
24: first operating lever
30: door release part for emergency
31: auxiliary motor
32: second driven gear
33: master lock link
34: pressurizing spring
40: inside emergency operating lever
50: outside emergency operating lever
60: key nut
70: key lever
80: second operating lever
90: third operating lever

DETAILED DESCRIPTION OF ILLUSTRATIVE EMBODIMENTS

The present invention will be described more fully hereinafter with reference to the accompanying drawings, in which exemplary embodiments of the invention are shown.

As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Since size and thickness of each component illustrated in the drawings are arbitrarily represented for convenience in explanation, the present invention is not particularly limited to the illustrated size and thickness of each component and the thickness is enlarged and illustrated in order to clearly express various parts and areas.

In the following description, dividing names of components into first, second and the like is to divide the names because the names of the components are the same as each other and an order thereof is not particularly limited.

Throughout the specification, unless explicitly described to the contrary, the word "comprise" and variations such as "comprises" or "comprising", will be understood to imply the inclusion of stated elements but not the exclusion of any other elements.

Referring to FIGS. 1 to 5, a motor-driven door latch for a vehicle according to an exemplary embodiment of the present invention may include a catch part 10 which is caught on a striker mounted on the vehicle to lock a door for a vehicle to the vehicle body or is released from the striker so that the door can be opened from the vehicle body; a door locking and releasing part 20 which applies torque to the catch part 10 to allow the catch part 10 to be locked to or released from the striker; and an emergency door releasing part 30 that allows the door locked to the vehicle body to be released from the vehicle body when the door locking and releasing part 20 is not operated due to battery discharge or collision, and the like.

The catch part 10 may include a catch 11, which is rotatably mounted on one side of a first base plate 1 and has a locking groove 111 which the striker mounted on the vehicle body is inserted into or separated from and a pawl 12, which is mounted on the first base plate 1 to be rotatable and is rotated within the rotation radius of the catch 11 to limit the rotation of the catch 11 or deviated from the rotation radius of the catch 11 to allow the catch 11 to be freely rotatable.

The door locking and releasing part 20 may include a main motor 21, which is mounted on a second base plate 2 to be rotatable in a clockwise and anticlockwise directions and includes a first drive gear 211; a first driven gear 22 engaged with the first drive gear 211; a pawl release lever 23 which is disposed with the first base plate 1 interposed therebetween and coupled to the pawl 12 to be integrally rotated (referring to FIG. 3); and a first operating lever 24, which is engaged with the first driven gear 22 and rotates while receiving a torque from the first driven gear 22 to rotate the pawl release lever 23.

The emergency door releasing part 30 may include an auxiliary motor 31 for emergency mounted on the first base plate 1 and provided with a second drive gear 311; a second driven gear 32 engaged with the second drive gear 311; a master locking link 33 of which one end portion is rotatably mounted on the first base plate 1 and the other end portion is provided with a hook 331; and a pressurizing spring 34 for pressurizing the master locking link 33 to be rotated in a clockwise direction.

When the user operates a release handle or a button mounted on the door, a door latch controller detects this to apply an operation signal to the main motor 21 to operate the main motor 21.

Figure 6:
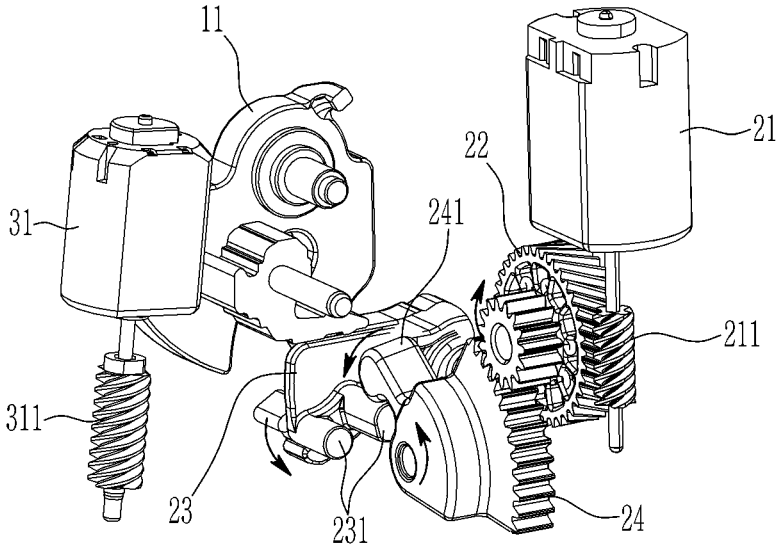
FIG. 6 is an operational explanatory diagram of the door locking and releasing part of the motor-driven door latch for the vehicle according to an exemplary embodiment of the present invention.

Referring to FIG. 6, the first drive gear 211 and the first driven gear 22 rotate respectively by driving the main motor 21, the first operating lever 24 engaged with the first driven gear 22 is rotated to push and rotate the pawl release lever 23, and the pawl 12 rotates together by the rotation of the pawl release lever 23 and is deviated from the rotation radius of the catch 11, so that the catch 11 can be freely rotated, thereby releasing the door locked the vehicle body to open the door.

Therefore, when the user pushes or pulls the door while holding the inside handle or the outside handle installed on the door, the door is opened while one side of the door is supported by the vehicle body and the door is being rotated.

The pawl release lever 23 may be provided with two seating protrusions 231 and the first operating lever 24 may be provided with a pressurizing protrusion 241 which is seated on the seating protrusions 231 to press and rotate the pawl release lever 23.

On the other hand, if the main motor fails due to a vehicle collision, the door latch controller or body control module (BCM) senses the vehicle collision through a collision detecting sensor and applies an actuating signal to the auxiliary motor 31.

Figure 7:
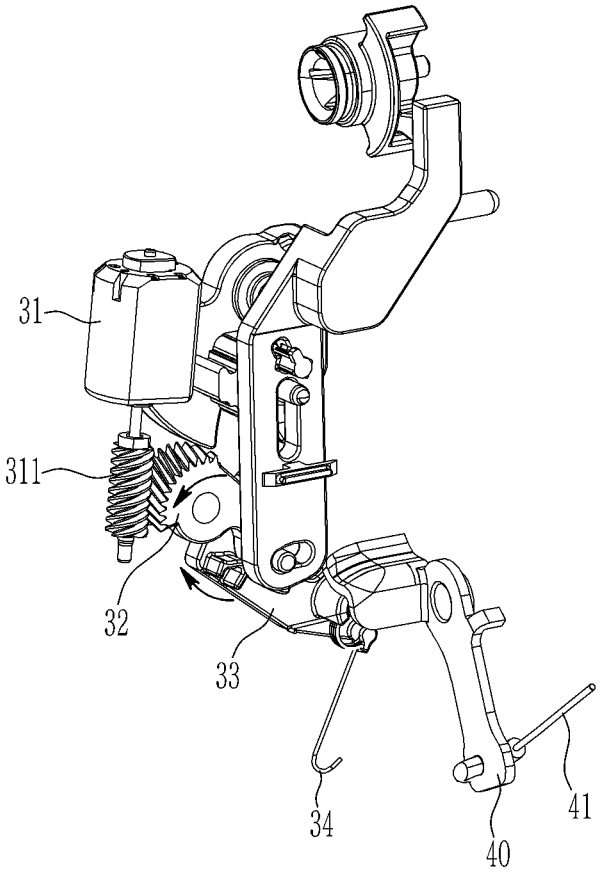
FIGS. 7 and 8 are operational explanatory diagrams of the emergency door releasing part of the motor-driven door latch for the vehicle according to an exemplary embodiment of the present invention.
Figure 8:
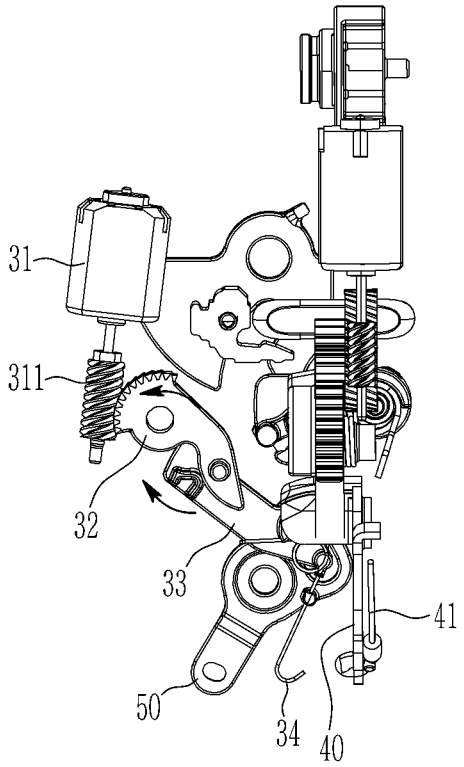

Thus, as shown FIGS. 7 and 8, the operation of the auxiliary motor 31 rotates the second drive gear 311 and the second driven gear 32 respectively, and the master locking link 33 is released from the second driven gear 32 by the rotation of the second driven gear 32 and rotates in a clockwise by the elastic restoring force of the pressurizing spring 34, so that a door lock release preparation state where a hook 331 of the master locking link 33 is hung on the seating protrusions 231 of the pawl release lever 23 is made.

Figure 9:
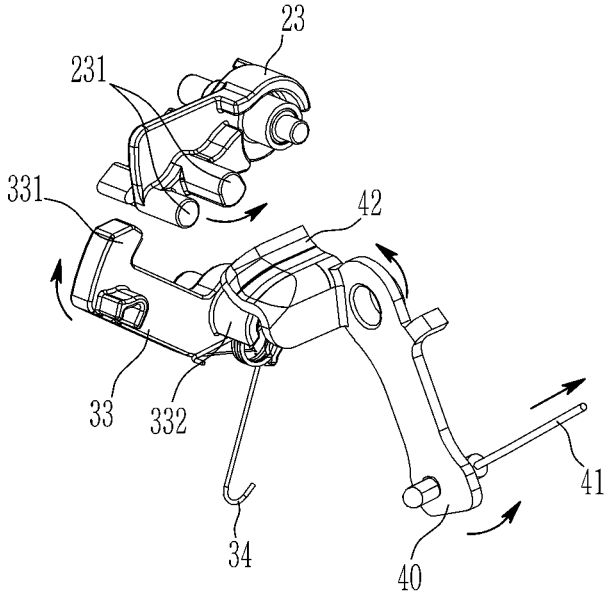
FIG. 9 is an operational explanatory diagram of an inside emergency operating lever and a master locking link of the motor-driven door latch for the vehicle according to an exemplary embodiment of the present invention.

In the door lock release preparation state, if a passenger pulls the inside handle in order to open the door, as shown in FIG. 9, the inside emergency operating lever 40 connected with the inside handle through a wire 41 is rotated.

The inside emergency operating lever 40 may be installed on the second base plate 2 to be rotatable and one end portion thereof may be provided with a pressurizing flange 42, as shown in FIG. 9.

Further, in the master locking link 33, a rotation inducing flange 332 may be formed in a circular arc shape corresponding to the pressurizing flange 42. The pressurizing flange 42 is integrally rotated by the rotation of the inside emergency operating lever 40 to press the rotation inducing flange 332 of the master locking link 33, so that the master locking link 33 further rotates in a clockwise direction from the door lock release preparation state where the master locking link 33 is hung on the seating protrusions 231 of the pawl release lever 23 to rotate the pawl release lever 23 in an anticlockwise. The pawl 12 is rotated by the rotation of the pawl release lever 23 together and thus deviated from the rotation radius of the catch 11, so that the catch 11 can be freely rotated. Thus, the door locked to the vehicle body is released from it and can be opened.

Figure 10:
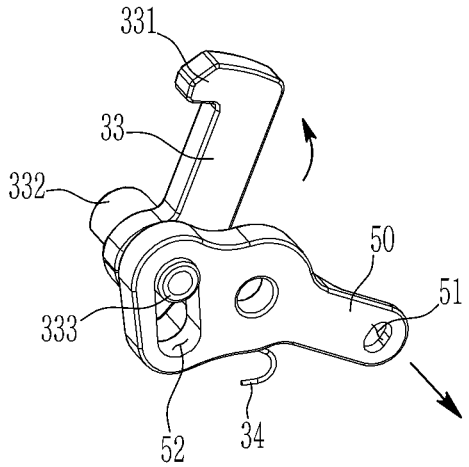
FIG. 10 is an operational explanatory diagram of an outside emergency operating lever and the master locking link of the motor-driven door latch for the vehicle according to an exemplary embodiment of the present invention.

On the other hand, in the door lock release preparation state, if the user pulls the outside handle, as shown in FIG. 10, an outside emergency operating lever 50 connected with the outside handle through a wire is rotated.

The outside emergency operating lever 50 may be installed on the second base plate 2 to be rotatable, one end portion thereof may be formed with a wire hole 51 with which a wire is connected and the other end portion thereof may be formed with a first long hole 52 into which a pin shaft 333 provided at the master locking link 33 is inserted.

When the outside emergency operating lever 50 is rotated, the master locking link 33 is further rotated in a clockwise direction from the door lock release preparation state by the rotation of the outside emergency operating lever 50 to rotate the pawl release lever 23 in an anticlockwise.

The pawl 12 is rotated by the rotation of the pawl release lever 23 together to be deviated from the rotation radius of the catch 11 to allow the catch 11 to freely rotate, so that the door locked to the vehicle body is released from it and the door can be opened.

Figure 11:
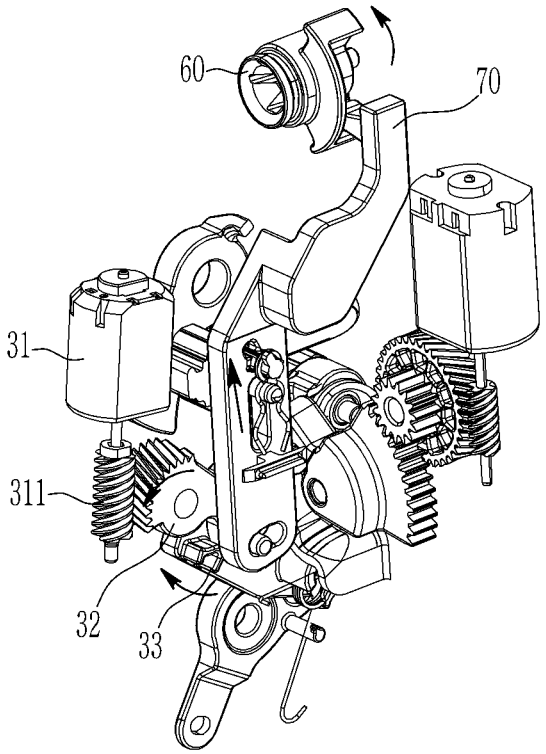
FIG. 11 is an operational explanatory diagram when operating a key for a vehicle of the motor-driven door latch for the vehicle according to an exemplary embodiment of the present invention.

On the other hand, when the battery of the vehicle is discharged and the main motor 21 and the auxiliary motor 31 become inoperable, if the user inserts a key for a vehicle a key hole to rotate a key cylinder, as shown in FIG. 11, a key nut 60 provided at the key cylinder is rotated and a key lever 70 is raised by the rotation of the key nut 60 to rotate the second driven gear 32. Thus, the rotation of the second driven gear 32 allows the master locking link 33 to be released from the second driven gear 32. The master locking link 33 is rotated by the elastic restoring force of the pressurizing spring 34 in a clockwise direction, so that the door lock release preparation state where the hook 331 of the master locking link 33 is hung on the seating protrusions 231 of the pawl release lever 23 is achieved.

In the door lock release preparation state, when the user pulls the outside handle, as described above, the outside emergency operating lever 50 is rotated so that the door can be opened.

Figure 12:
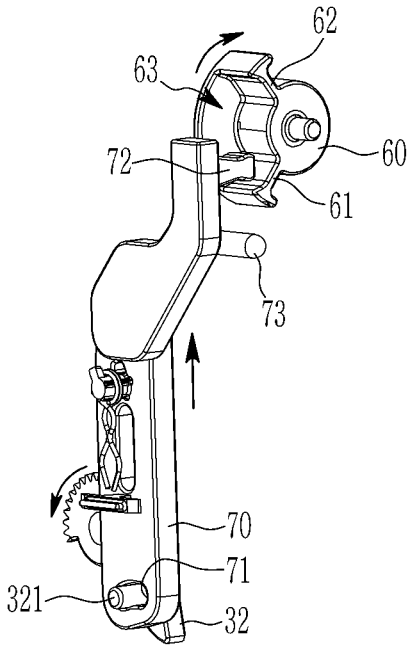
FIG. 12 is an operational explanatory diagram of a key nut and a key lever of the motor-driven door latch for the vehicle according to an exemplary embodiment of the present invention.

Referring to FIG. 12, a second long hole 71 may be formed at a lower portion of the key lever, a coupling protrusion 321 inserted into the second long hole 71 may be provided at the second driven gear 32, a protrusion 72 may be provided on an upper portion of the key lever 70, two operating protrusions 61 and 62 spaced from each other in a circumference direction may be provided at the key nut 60 and a movable groove 63 which the protrusion 72 is inserted into and can move therein may be provided between the first and second operating protrusions 61 and 62.

That is, when the auxiliary motor 31 is operated and the second driven gear 32 is rotated, the key lever 70 moves up and down by the rotation of the second driven gear 32 but the protrusion 72 of the key lever 70 moves up and down in the movable groove 63 of the key nut 60, so that the protrusion 72 of the key lever 70 is not contacted with the first and second operating protrusions 61 and 62 of the key nut 60.

On the other hand, when the key nut 60 is rotated by operation of the key for a vehicle, the key lever 70 is contacted with the first operating protrusion 61 to be forcibly raised up, so that the second driven gear 32 is forcibly rotated by the key lever 70 and the master locking link 33 rotates also, thereby achieving the door lock release preparation state.

On the other hand, when the main motor 21 and the auxiliary motor 31 are inoperable simultaneously, as shown in FIG. 11, it is able to release the door locked to the vehicle body by rotating a key cylinder through the key of the outside the vehicle, but the passenger inside the vehicle should also be able to open the door.

Figure 2:
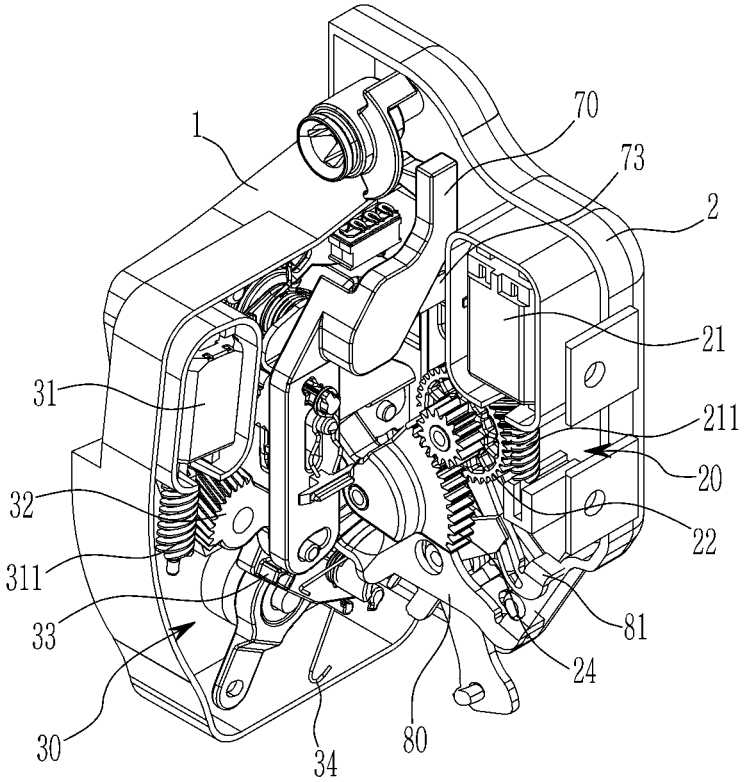
FIG. 2 is a front view of the motor-driven door latch for the vehicle according to an exemplary embodiment of the present invention.
Figure 3:
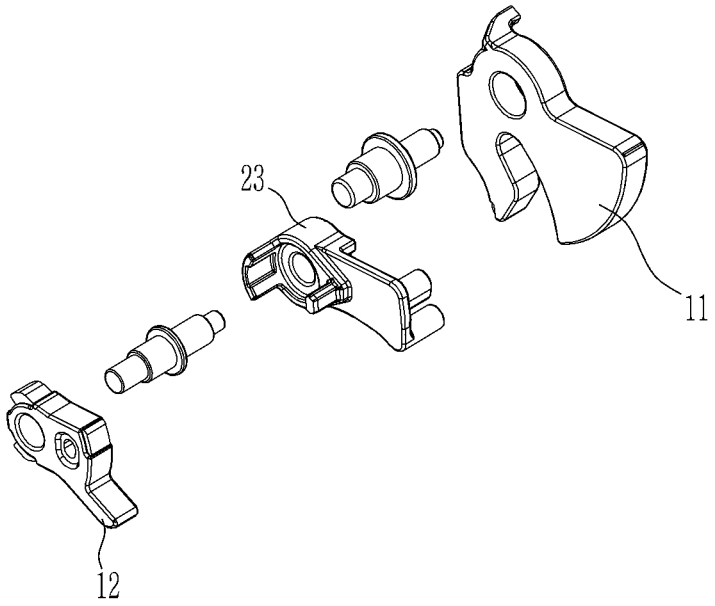
FIG. 3 is an exploded perspective view of a catch part of the motor-driven door latch for the vehicle according to an exemplary embodiment of the present invention.
Figure 4:
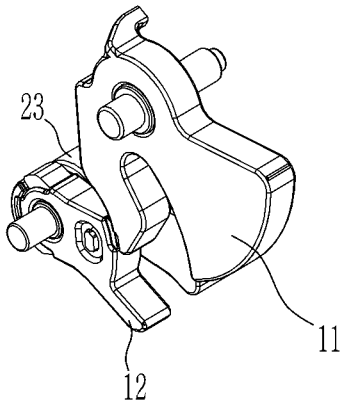
FIG. 4 is a perspective view showing coupling state of a pawl and a pawl release lever of the motor-driven door latch for the vehicle according to an exemplary embodiment of the present invention.
Figure 5:
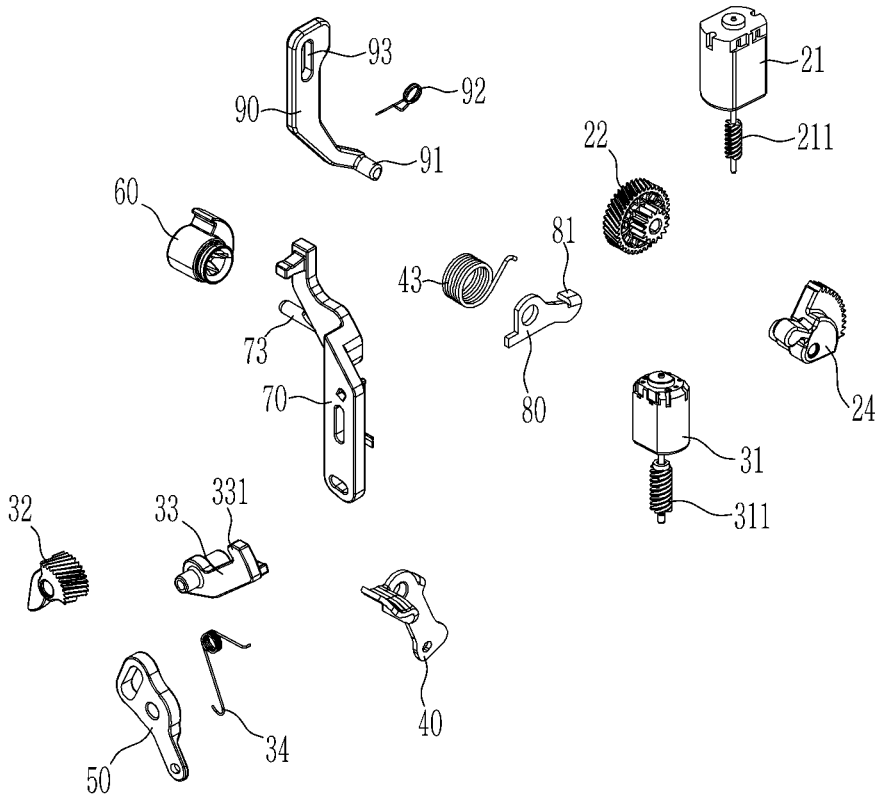
FIG. 5 is an exploded perspective view of a door locking and releasing part and an emergency door releasing part of the motor-driven door latch for the vehicle according to an exemplary embodiment of the present invention.

For this, a second operating lever 80, as shown in FIG. 2, may be coupled to the rotation shaft of the inside emergency operating lever 40 to be rotated together.

The second operating lever 80 is described separately from the inside emergency operating lever 40 and rotates with the inside emergency operating lever 40, but the second operating lever 80 can be integrally formed with the inside emergency operating lever 40.

The inside emergency operating lever 40 may be provided with a return spring 43 for returning the original emergency operating lever 40 to its original position after being rotated according to the operation of the inside handle.

The second operating lever 80 may be provided with a push protrusion 81.

A third actuating lever 90 with a driven protrusion 91 pushed by the push protrusion 81 when the second operating lever 80 is rotated, may be further included.

The third actuating lever 90 may be moved up and down in the drawings.

A return spring 92 may be installed on the third actuating lever 90 to return to its original position after the third actuating lever 90 is pushed by the push protrusion 81.

One side of the third operating lever 90 may be provided with a long hole 93.

An upper portion of the key lever 70 may be provided with a connection protrusion 73 which is inserted into the long hole 93 and connects the key lever 70 to the third operating lever 90.

One end portion of the return spring 92 may be supported by the connection protrusion 73.

Figure 13:
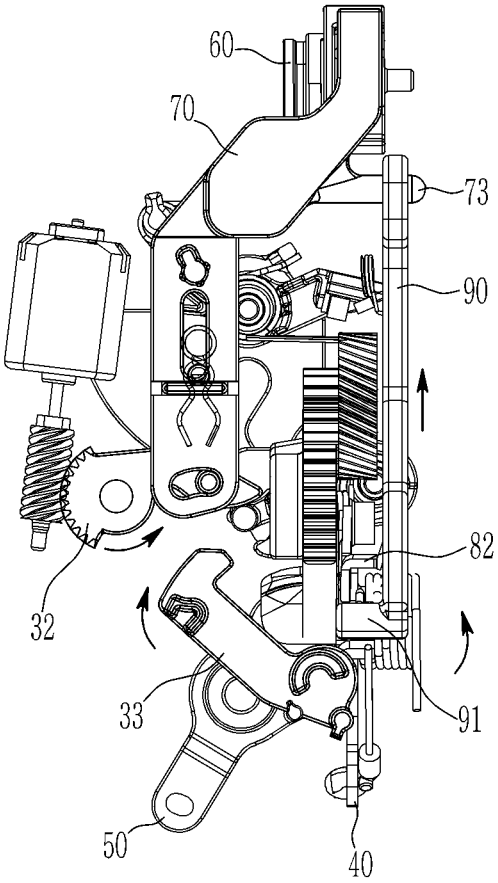
FIG. 13 is an explanatory diagram of the first motion of the motor-driven door latch for the vehicle according to an exemplary embodiment of the present invention.

Thus, when the main motor 21 and the auxiliary motor 31 are inoperable at the same time so that the motor cannot be used to release the locked door from the vehicle body, if a passenger operates the inside handle in order to open the door (the first motion), as shown in FIG. 13, the inside emergency operating lever 40 connected with the inside handle rotates around its rotation shaft and the second operating lever 80 rotates together with the inside emergency operating lever 40 also so that the push protrusion 82 of the second operating lever 80 pushes up the driven protrusion 91 of the third operating lever 90.

Therefore, the third operating lever 90 is pushed up by the second operating lever 80 to compress the return spring 92 and the return spring 92 pushes up the key lever 70 again after compressed at predetermined displacement amount, so that the second driven gear 32 of which the coupling protrusion 321 is inserted into the second long hole 71 formed at one end portion of the key lever 70, as shown in FIG. 13, is forcibly rotated in an anticlockwise by the upward movement of the key lever 70.

The master lock link 33 is released from the second driven gear 32 by the rotation of the second driven gear 32 and then rotates in a clockwise direction by the elastic restoring force of the pressurizing spring 34, so that the hook 331 of the master lock link 33 is hung on the seating protrusions 231 of the pawl release lever 23, thereby achieving the door lock release preparation state.

Figure 14:
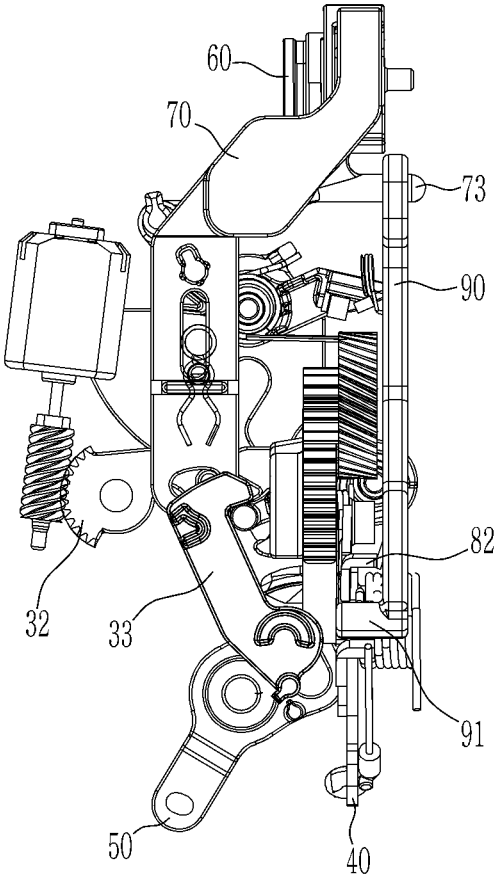
FIG. 14 shows the motor-driven door latch for the vehicle according to an exemplary embodiment of the present invention that has completed the first motion.

In this state, if a passenger releases the inside handle, as shown in FIG. 14, the inside emergency operating lever 40 and the second operating lever 80 are returned to its original position by the elastic restoring force of the return spring 43, respectively and the third operating lever 90 is returned to its original position by the elastic restoring force of the return spring 92, but the door lock release preparation state where the hook 331 of the master lock link 33 is hung on the seating protrusions 231 of the pawl release lever 23 is maintained.

Subsequently, when the passenger manipulates by pulling the inside handle again (the second motion), as shown in FIG. 14, the inside emergency operating lever 40 connected with the inside handle through wire 41 is rotated again in the door lock release preparation state and the pressurizing flange 42 is integrally rotated by the rotation of the inside emergency operating lever 40, as shown in FIG. 9, to press the rotation inducing flange 332 of the master lock link 33, so that the master lock link 33 is further rotated in a clockwise direction from the door lock release preparation state where it is hung on the seating protrusions 231 of the pawl release lever 23, to rotate the pawl release lever 23 in an anticlockwise direction. Therefore, the pawl 12 is rotated together by the rotation of the pawl release lever 23 to deviate from the rotation radius of the catch 11, so that the catch 11 can be freely rotated, whereby the door locked to the vehicle body is release from the vehicle body the door can be opened.

In the present invention, the power child lock function can be also implemented. That is, when the rear seat passenger operates by pulling the inside handle to open the door in a state where the driver operates a power child lock switch to lock a rear door to the vehicle body, the inside emergency operating lever 40 connected with the inside handle is rotated around its rotation shaft and the second operating lever 80 is rotated together with the inside emergency operating lever 40, so that the push protrusion 82 pushes up the driven protrusion 91 of the third operating lever 90.

Therefore, the third operating lever 90 is pushed up by the second operating lever 80 to compress the return spring 92, and the return spring 92 pushes up the key lever 70 after compressed at a predetermined displacement amount, so that the second driven gear 32, whose the coupling protrusion 321 is inserted into the second long hole 71 formed at one end portion of the key lever 70, is forced to anticlockwise rotate according to the upward movement of the key lever 70.

At this time, the door latch controller C or body control module BCM detects the switch-on state of the power child lock switch and the rotation of the second driven gear 32 through a rotation detecting sensor 35 attached at the second driven gear 32 to operate the auxiliary motor 31.

Then, the second driven gear 32 receives the clockwise torque according to the upward movement of the key lever 70 and the anticlockwise torque by the auxiliary motor 31 simultaneously, so that the second driven gear 32 is unable to rotate or undergoes a rotational vibration in place. Therefore, the rear door does not reach the door lock release preparation state and remains locked in the vehicle body so that a power child lock function to limit the rear door opening is achieved.

On the other hand, when the rear seat passenger releases the inside handle again, the inside emergency operating lever 40, the second operating lever 80 and the third operating lever 90 are returned to its original position, respectively, and even if the rear seat passenger operates the inside handle again in order to open the rear door, the above-described series of operations are repeatedly performed. Thus, when the power child lock is executed, the rear door cannot be opened.

On the other hand, in a case where the driver leaves the vehicle after parking the vehicle, the dead lock function, which prevents the door of the vehicle from being opened, for example, in order to prevent theft of the vehicle, can be performed as follows.

Figure 15:
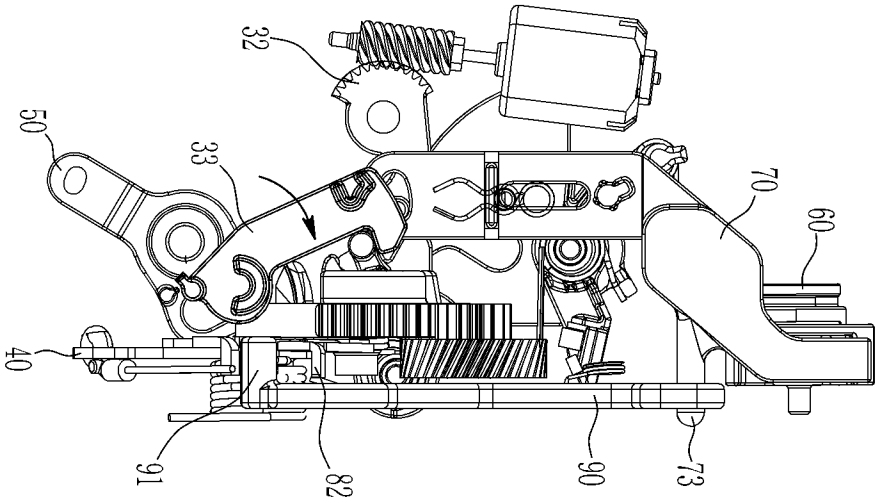
FIG. 15 is an explanatory diagram of the second motion of the motor-driven door latch for the vehicle according to an exemplary embodiment of the present invention.
Figure 16:
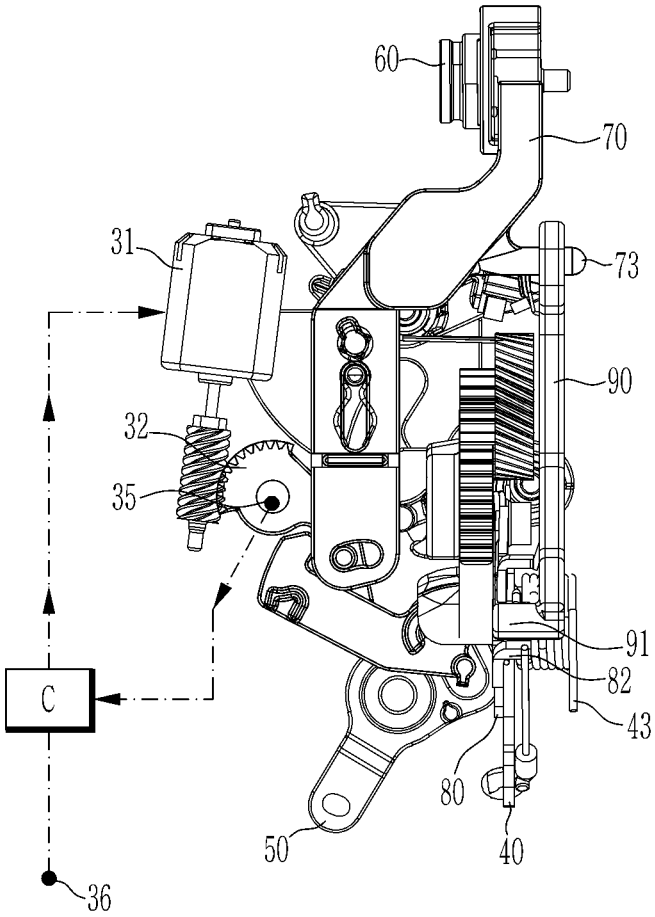
FIG. 16 is an explanatory diagram of the operation of a power child lock function and a dead lock function of the motor-driven door latch for the vehicle according to the embodiment of the present invention.

That is, after the driver locks the door for the vehicle to the vehicle body and then leaves the vehicle, if the thief of the vehicle breaks the glass of the vehicle and enters the interior of the vehicle and then manipulates the inside handle to open the door, the door latch controller or body control module, as shown in FIG. 15, senses the parked state of the vehicle through the parking switch 36, senses the rotation of the second driven gear 32 according to the manipulation of the inside handle and actuates the auxiliary motor 31.

Accordingly, the second driven gear 32 cannot be rotated by the operation of the auxiliary motor 31 even if the inside emergency operating lever 40 is operated by the operation of the inside handle, thereby not entering the door lock release preparation state, the door for the vehicle door cannot be opened.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A motor-driven door latch for a vehicle having a vehicle body and a door, the motor-driven door latch comprising:

a catch part which is caught on a striker mounted on the vehicle to lock the door to the vehicle body or is released from the striker so that the door is configured to be opened from the vehicle body, wherein the catch part comprises a catch having a locking groove and a pawl, the catch and the pawl being installed to be rotatable, wherein the striker mounted on the vehicle body is configured to be caught in or separated from the catch and the pawl being in close contact with the catch to limit rotation of the catch or separated from the catch to allow the catch to be freely rotatable;

a door locking and releasing part configured to apply torque to the catch part to allow the catch part to be locked to or released from the striker, wherein the door locking and releasing part comprises a main motor that is configured to rotate in a clockwise and anticlockwise direction and includes a first drive gear, a first driven gear engaged with the first drive gear, a pawl release lever coupled to the pawl to be integrally rotated, and a first operating lever that is engaged with the first driven gear and configured to receive the torque through the first driven gear to rotate the pawl release lever;

a motor-driven emergency door releasing part comprising an auxiliary motor that includes a second drive gear, a second driven gear engaged with the second drive gear, a master locking link including a hook at one end portion thereof and contacted with the second driven gear so that rotation of the second driven gear is limited, and a pressurizing spring configured to apply an elastic force to the master locking link in order to rotate the master locking link in a direction, wherein the motor-driven emergency door releasing part is contacted with the door locking and releasing part by operation of the auxiliary motor when the main motor is not operated;

an inside emergency operating lever connected with an inside handle installed at the door, the inside emergency operating lever configured to receive an operation force of the inside handle to rotate and to apply torque to the catch part through the motor-driven emergency door releasing part and the door locking and releasing part;

an outside emergency operating lever connected with an outside handle installed at the door, the outside emergency operating lever configured to receive an operation force of the outside handle to rotate and to apply torque to the catch part through the motor-driven emergency door releasing part and the door locking and releasing part; and a manual emergency door release part connected with the inside emergency operating lever, the manual emergency door release part configured to receive an operation force of the inside emergency operating lever to move and to apply torque to the catch part through the motor-driven emergency door releasing part and the door locking and releasing part;

wherein the inside emergency operating lever is installed to be rotatable and one end portion of the inside emergency operating lever is provided with a pressurizing flange; and wherein the master locking link is provided with a rotation inducing flange that corresponds to the pressurizing flange and is configured to be pressed by the pressurizing flange down to rotate the master locking link.

2. The motor-driven door latch for the vehicle of claim 1, further comprising:

a power child lock switch;

a rotation detecting sensor configured to detect the second driven gear; and a door latch controller configured to control operation of the main motor and the auxiliary motor, wherein the door latch controller is configured to actuate the auxiliary motor when simultaneously detecting an on-state of the power child lock switch and the rotation of the second driven gear through the rotation detecting sensor.

3. The motor-driven door latch for the vehicle of claim 1, further comprising:

a parking switch;

a rotation detecting sensor configured to detect the second driven gear; and a door latch controller configured to control operation of the main motor and the auxiliary motor, wherein the door latch controller is configured to actuate the auxiliary motor when simultaneously detecting an on-state of the parking switch and the rotation of the second driven gear through the rotation detecting sensor.

4. The motor-driven door latch for the vehicle of claim 1, further comprising a door latch controller configured to detect an operation of a handle or a button installed at the door of the vehicle and to apply an operating signal to the main motor.

5. A motor-driven door latch for a vehicle having a vehicle body and a door, the motor-driven door latch comprising:

a catch part which is caught on a striker mounted on the vehicle to lock the door to the vehicle body or is released from the striker so that the door is configured to be opened from the vehicle body, wherein the catch part comprises a catch having a locking groove and a pawl, the catch and the pawl being installed to be rotatable, wherein the striker mounted on the vehicle body is configured to be caught in or separated from the catch and the pawl being in close contact with the catch to limit rotation of the catch or separated from the catch to allow the catch to be freely rotatable;

a door locking and releasing part configured to apply torque to the catch part to allow the catch part to be locked to or released from the striker, wherein the door locking and releasing part comprises a main motor that is configured to rotate in a clockwise and anticlockwise direction and includes a first drive gear, a first driven gear engaged with the first drive gear, a pawl release lever coupled to the pawl to be integrally rotated, and a first operating lever that is engaged with the first driven gear and configured to receive the torque through the first driven gear to rotate the pawl release lever;

a motor-driven emergency door releasing part comprising an auxiliary motor that includes a second drive gear, a second driven gear engaged with the second drive gear, a master locking link including a hook at one end portion thereof and contacted with the second driven gear so that rotation of the second driven gear is limited, and a pressurizing spring configured to apply an elastic force to the master locking link in order to rotate the master locking link in a direction, wherein the motor-driven emergency door releasing part is contacted with the door locking and releasing part by operation of the auxiliary motor when the main motor is not operated;

an inside emergency operating lever connected with an inside handle installed at the door, the inside emergency operating lever configured to receive an operation force of the inside handle to rotate and to apply torque to the catch part through the motor-driven emergency door releasing part and the door locking and releasing part;

an outside emergency operating lever connected with an outside handle installed at the door, the outside emergency operating lever configured to receive an operation force of the outside handle to rotate and to apply torque to the catch part through the motor-driven emergency door releasing part and the door locking and releasing part; and a manual emergency door release part connected with the inside emergency operating lever, the manual emergency door release part configured to receive an operation force of the inside emergency operating lever to move and to apply torque to the catch part through the motor-driven emergency door releasing part and the door locking and releasing part;

wherein the outside emergency operating lever is installed to be rotatable, one end portion of the outside emergency operating lever being provided with a wire hole with which a wire is connected and another end portion of the outside emergency operating lever being formed with a first long hole; and wherein the master locking link is provided with a pin shaft inserted into the first long hole.

6. The motor-driven door latch for the vehicle of claim 5, further comprising:

a power child lock switch;

a rotation detecting sensor configured to detect the second driven gear; and a door latch controller configured to control operation of the main motor and the auxiliary motor, wherein the door latch controller is configured to actuate the auxiliary motor when simultaneously detecting an on-state of the power child lock switch and the rotation of the second driven gear through the rotation detecting sensor.

7. The motor-driven door latch for the vehicle of claim 5, further comprising:

a parking switch;

a rotation detecting sensor configured to detect the second driven gear; and a door latch controller configured to control operation of the main motor and the auxiliary motor, wherein the door latch controller is configured to actuate the auxiliary motor when simultaneously detecting an on-state of the parking switch and the rotation of the second driven gear through the rotation detecting sensor.

8. The motor-driven door latch for the vehicle of claim 5, further comprising a door latch controller configured to detect an operation of a handle or a button installed at the door of the vehicle and to apply an operating signal to the main motor.

9. A motor-driven door latch for a vehicle having a vehicle body and a door, the motor-driven door latch comprising:

a catch part which is caught on a striker mounted on the vehicle to lock the door to the vehicle body or is released from the striker so that the door is configured to be opened from the vehicle body, wherein the catch part comprises a catch having a locking groove and a pawl, the catch and the pawl being installed to be rotatable, wherein the striker mounted on the vehicle body is configured to be caught in or separated from the catch and the pawl being in close contact with the catch to limit rotation of the catch or separated from the catch to allow the catch to be freely rotatable;

a door locking and releasing part configured to apply torque to the catch part to allow the catch part to be locked to or released from the striker, wherein the door locking and releasing part comprises a main motor that is configured to rotate in a clockwise and anticlockwise direction and includes a first drive gear, a first driven gear engaged with the first drive gear, a pawl release lever coupled to the pawl to be integrally rotated, and a first operating lever that is engaged with the first driven gear and configured to receive the torque through the first driven gear to rotate the pawl release lever;

a motor-driven emergency door releasing part comprising an auxiliary motor that includes a second drive gear, a second driven gear engaged with the second drive gear, a master locking link including a hook at one end portion thereof and contacted with the second driven gear so that rotation of the second driven gear is limited, and a pressurizing spring configured to apply an elastic force to the master locking link in order to rotate the master locking link in a direction, wherein the motor-driven emergency door releasing part is contacted with the door locking and releasing part by operation of the auxiliary motor when the main motor is not operated;

an inside emergency operating lever connected with an inside handle installed at the door, the inside emergency operating lever configured to receive an operation force of the inside handle to rotate and to apply torque to the catch part through the motor-driven emergency door releasing part and the door locking and releasing part;

an outside emergency operating lever connected with an outside handle installed at the door, the outside emergency operating lever configured to receive an operation force of the outside handle to rotate and to apply torque to the catch part through the motor-driven emergency door releasing part and the door locking and releasing part;

a manual emergency door release part connected with the inside emergency operating lever, the manual emergency door release part configured to receive an operation force of the inside emergency operating lever to move and to apply torque to the catch part through the motor-driven emergency door releasing part and the door locking and releasing part; and a key cylinder into which a key for the vehicle is configured to be inserted, the key cylinder being provided with a key nut that is connected with one end portion of a key lever, another end portion of the key lever being connected with the second driven gear.

10. The motor-driven door latch of claim 9, further comprising:

two seating protrusions formed at the pawl release lever; and a pressurizing protrusion which seats on the seating protrusions provided at the first operating lever, the pressurizing protrusion configured to press and rotate the pawl release lever, is provided at the first operating lever.

11. The motor-driven door latch for the vehicle of claim 9, wherein:

the key lever is formed with a second long hole at a lower portion thereof; and the second driven gear is provided with a coupling protrusion inserted into the second long hole.

12. The motor-driven door latch for the vehicle of claim 11, wherein:

a protrusion is provided at an upper portion of the key lever;

the key nut is provided with first and second operating protrusions spaced from each other in a circumference direction; and a movable groove into which the protrusion is inserted to move is provided between the first and second operating protrusions.

13. The motor-driven door latch for the vehicle of claim 9, wherein the manual emergency door release part comprises:

a second operating lever coupled to a rotation shaft of the inside emergency operating lever to be integrally rotated;

a return spring installed at the rotation shaft of the inside emergency operating lever to return the inside emergency operating lever to its original position;

a third operating lever installed to be moved by the second operating lever when the second operating lever rotates; and a return spring installed at the third operating lever to return the third operating lever to its original position after the third operating lever is moved.

14. The motor-driven door latch of claim 13, wherein the key lever is connected with the third operating lever in order to be moved by the third operating lever.

15. The motor-driven door latch for the vehicle of claim 14, wherein:

the second operating lever is provided with a push protrusion; and the third operating lever is provided with a driven protrusion to be pushed by the push protrusion when the second operating lever rotates.

16. The motor-driven door latch for the vehicle of claim 14, wherein:

one side of the third operating lever is provided with a long hole; and an upper portion of the key lever is provided with a connection protrusion inserted into the long hole to connect the key lever with the third operating lever.

17. The motor-driven door latch for the vehicle of claim 9, further comprising:

a power child lock switch;

a rotation detecting sensor configured to detect the second driven gear; and a door latch controller configured to control operation of the main motor and the auxiliary motor, wherein the door latch controller is configured to actuate the auxiliary motor when simultaneously detecting an on-state of the power child lock switch and the rotation of the second driven gear through the rotation detecting sensor.

18. The motor-driven door latch for the vehicle of claim 9, further comprising:

a parking switch;

a rotation detecting sensor configured to detect the second driven gear; and a door latch controller configured to control operation of the main motor and the auxiliary motor, wherein the door latch controller is configured to actuate the auxiliary motor when simultaneously detecting an on-state of the parking switch and the rotation of the second driven gear through the rotation detecting sensor.

19. The motor-driven door latch of claim 9, further comprising a door latch controller configured to detect an operation of a handle or a button installed at the door of the vehicle and to apply an operating signal to the main motor.

20. The motor-driven door latch for the vehicle of claim 19, wherein the auxiliary motor is configured to be actuated by the operating signal of the door latch controller when the main motor is inoperable.

* * * * *